US007585192B1

(12) United States Patent
Lai

(10) Patent No.: US 7,585,192 B1
(45) Date of Patent: Sep. 8, 2009

(54) ELECTRICAL CONNECTOR

(75) Inventor: Ming-Chun Lai, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/391,582

(22) Filed: Feb. 24, 2009

(51) Int. Cl.
*H01R 13/24* (2006.01)

(52) U.S. Cl. ..... 439/700

(58) Field of Classification Search ..... 439/700, 439/824, 289, 79, 80, 752
See application file for complete search history.

(56) References Cited

U.S. PATENT DOCUMENTS 7,144,278 B2 * 12/2006 Le Gallic et al. ..... 439/700

7,275,968 B1 * 10/2007 Chiang ..... 439/660

* cited by examiner

*Primary Examiner*—Phuong K Dinh
(74) *Attorney, Agent, or Firm*—WPAT, P.C.; Anthony King

(57) ABSTRACT

An electrical connector includes a housing and a plurality of terminals disposed in the housing. The housing defines a plurality of passageways passing through a rear surface and a front surface thereof. An upper portion of a rear of the passageway extends sideward to form a fixing slot and a bottom thereof extends downward and then forward to form a receiving fillister. Each of the terminals has a base board received in the passageway. A top end of the base board is bent sideward to form a fixing portion buckled in the corresponding fixing slot. A rear of a bottom end of the base board extends downward and then is bent forward to form a holding portion held in the corresponding receiving fillister. A free end of the holding portion is bent downward and extends forward to form a soldering portion located under a bottom surface of the housing.

4 Claims, 4 Drawing Sheets

ELECTRICAL CONNECTOR

BACKGROUND OF THE INVENTION

1. Field of the Invention

The present invention generally relates to a connector, and more particularly to an electrical connector.

2. The Related Art

Referring to FIG. 1, conventionally, an electrical connector 1' includes a housing 10' and a plurality of terminals 20'. Each of the terminals 20' has a rectangular base board 21' extending vertically. A rear edge of the base board 21' extends rearward to form a bar-shaped soldering portion 22' and a top of a front edge thereof extends forward to form an elastic portion 23' with a substantially serpentine shape. A front of the elastic portion 23' extends forward to form a substantially rectangular contact arm 24'. The base board 21' and the elastic portion 23' are disposed in the housing 10'. The contact arm 24' is inserted in the housing 10 and a free end thereof stretches out of a front surface of the housing 10'. The soldering portion 22' stretches out of a rear surface of the housing 10' for being soldered to a printed circuit board (not shown).

However, the terminal 20' is assembled in the housing 10' only by means of the base board 21' being fastened in the housing 10'. As a result, when the electrical connector 1' is shaken in use, the terminal 20' is apt to fall off the housing 10'. Furthermore, the length of the electrical connector 1' is relatively longer due to the soldering portion 22' stretching out of the rear surface of the housing 10' so that it makes the electrical connector 1' occupy a relatively larger space in a matching electronic device.

SUMMARY OF THE INVENTION

An object of the present invention is to provide an electrical connector including a housing and a plurality of terminals disposed in the housing. The housing has a front surface, a rear surface and a bottom surface and defines a passageway extending longitudinally to pass through the rear surface and the front surface. The upper portion of a rear of the passageway extending sideward to form a fixing slot, and a bottom thereof extends downward and then forward to form a receiving fillister penetrating through the bottom surface. The terminal is substantially disposed in the passageway of the housing and includes a base board extending vertically, a contact arm with a front end thereof projecting out of the passageway and an elastic portion elastically connecting the contact arm to the base board. A top end of the base board is bent sideward to form a fixing portion, a rear of a bottom end of the base board extends downward and then is bent forward to form a holding portion. A free end of the holding portion is bent downward and then extends forward to form a soldering portion. The fixing portion is buckled in the corresponding fixing slot and the holding portion is held in the corresponding receiving fillister, the soldering portion is located under the bottom surface.

As described above, the fixing portion of each of the terminals is buckled in the corresponding fixing slot of the housing and the holding portion is held in the corresponding receiving fillister so that can ensure the terminals assembled in the housing firmly. Moreover, the soldering portion is located under the bottom surface of the housing so that can reduce the length of the electrical connector and further reduce an occupation space of the electrical connector in a matching electronic device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
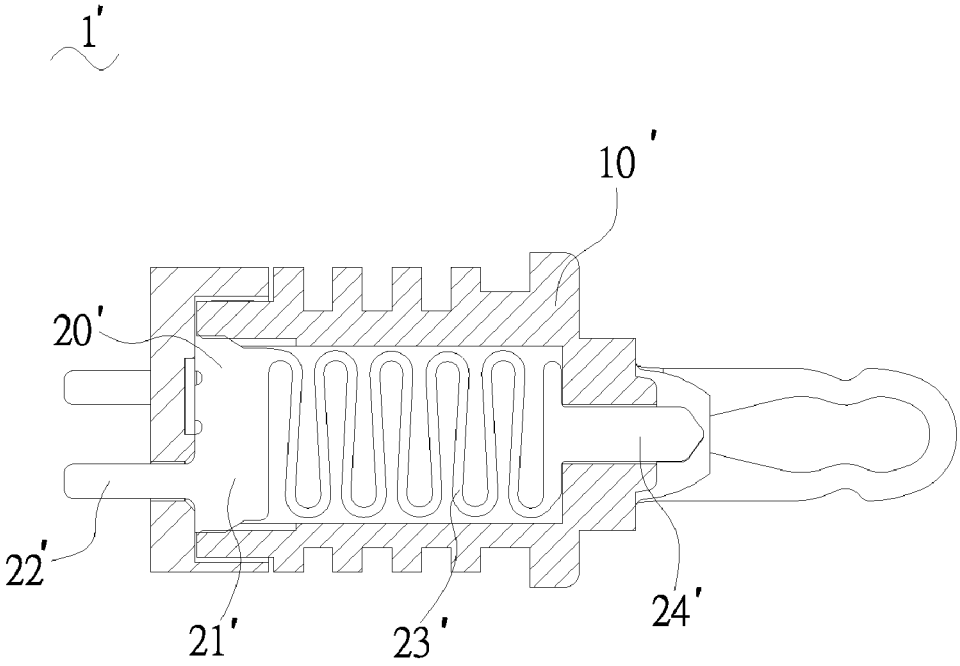
FIG. 1 is a cross-sectional view of a conventional electrical connector.
Figure 2:
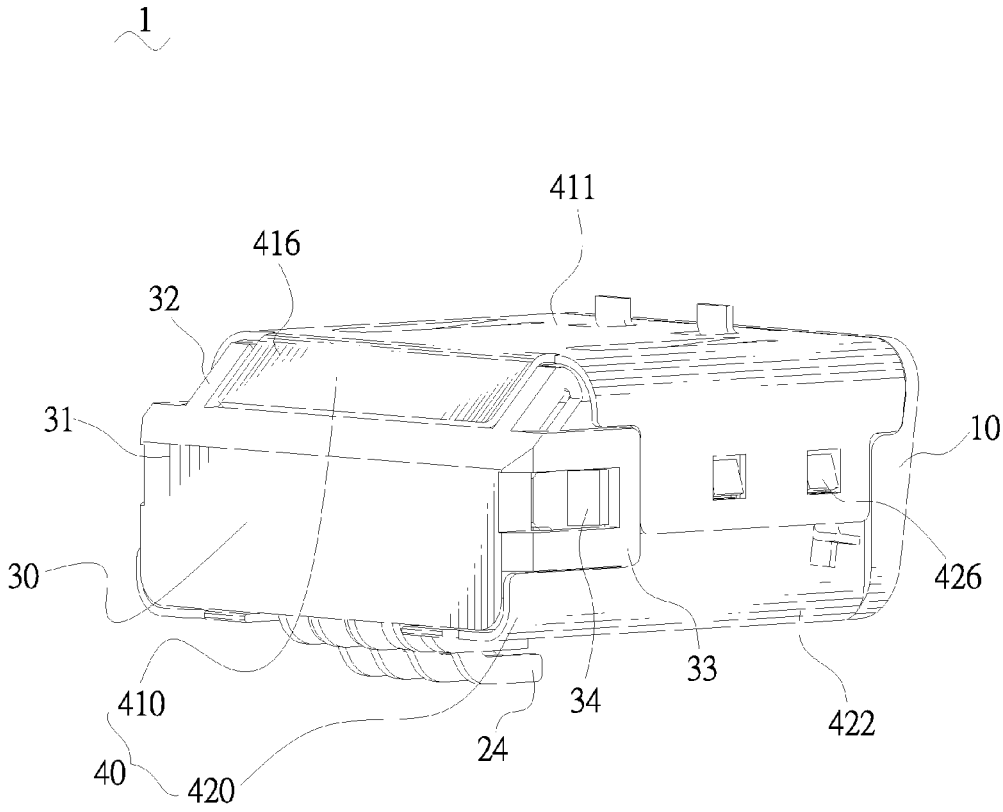
FIG. 2 is a perspective view of an electrical connector in accordance with the present invention.
Figure 3:
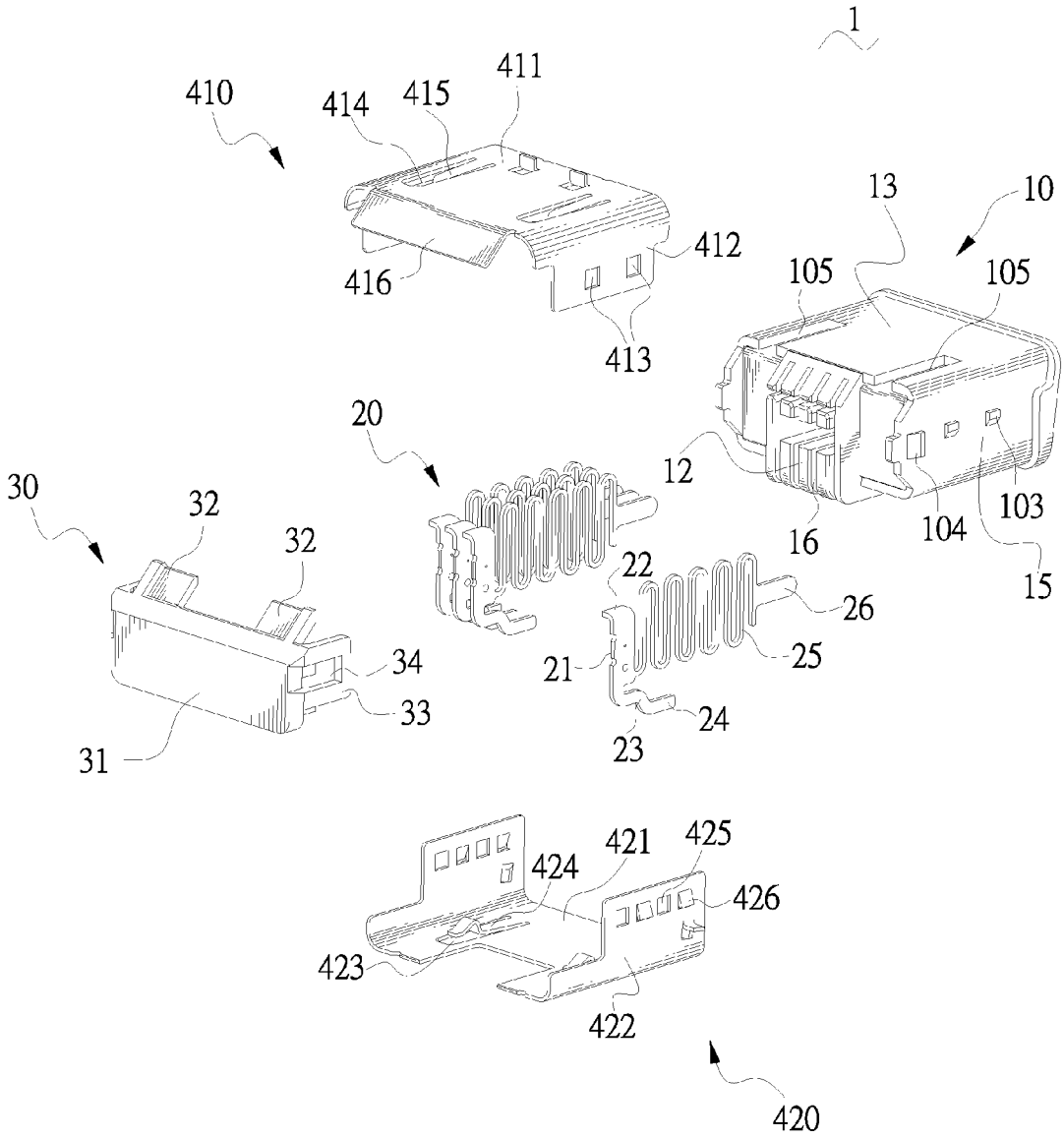
FIG. 3 is an exploded view of the electrical connector of FIG. 2.

With reference to FIG. 2 and FIG. 3, an electrical connector 1 in accordance with one embodiment of the present invention includes a housing 10, a plurality of terminals 20 disposed in the housing 10, a cover 30 and a shell assembly 40 mounted on the housing 10 respectively.

Figure 5:
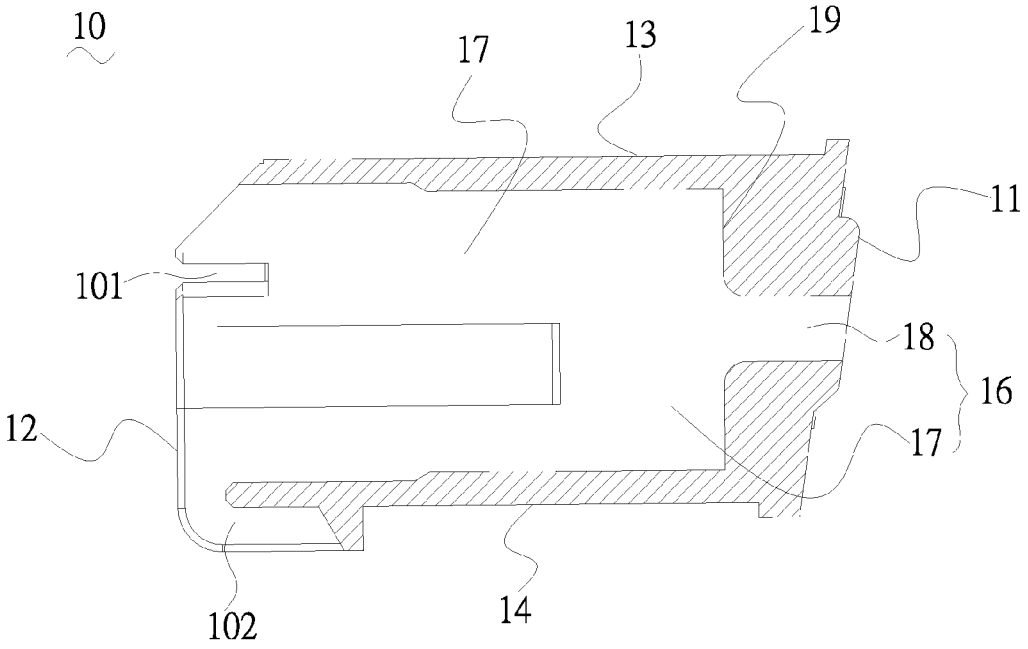
FIG. 5 is a cross-sectional view of a housing of the electrical connector of FIG. 3.

Referring to FIG. 3 and FIG. 5, the housing 10 is of rectangular shape and has a front surface 11, a rear surface 12, a top surface 13, a bottom surface 14 and a pair of side surfaces 15. A middle of the housing 10 defines a plurality of passageways 16 arranged at regular intervals along a transverse direction thereof and each extending longitudinally to pass through the front surface 11 and the rear surface 12. The passageway 16 includes a receiving cavity 17 passing through the rear surface 12. A middle of a front of the receiving cavity 17 extends forward to pass through the front surface 11 to form an inserting cavity 18. Accordingly, a pair of preventing surfaces 19 is formed at the junction of the receiving cavity 17 and the corresponding inserting cavity 18. An upper portion of a rear of each of the receiving cavities 17 extends sideward to form a fixing slot 101 passing through the rear surface 12, and a bottom thereof extends downward and then extends forward to form a receiving fillister 102 penetrating through the bottom surface 14. A middle of each of two side surfaces 15 protrudes outward to form two holding blocks 103 spaced from each other, and a middle of a rear thereof protrudes outward to form a fixing lump 104. The top surface 13 defines two holding grooves 105 extending longitudinally to penetrate through a rear edge thereof.

Figure 4:
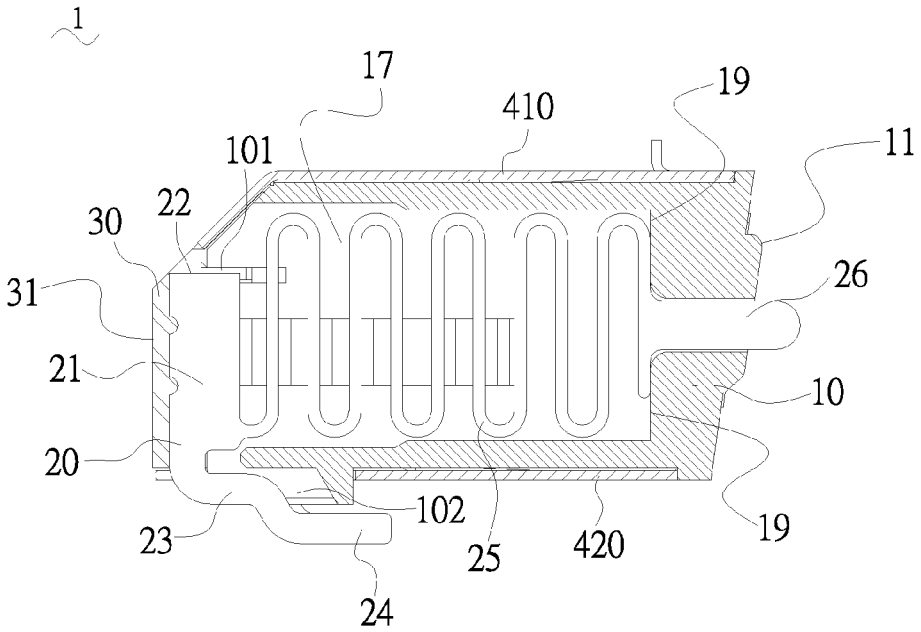
FIG. 4 is a cross-sectional view of the electrical connector of FIG. 2.

Referring to FIG. 3 and FIG. 4, each of the terminals 20 has a rectangular base board 21 disposed vertically. A top end of the base board 21 is bent sideward to form a fixing portion 22. A rear of a bottom end of the base board 21 extends downward and then is bent forward to form a holding portion 23. A free end of the holding portion 23 is bent downward and then extends forward to form a soldering portion 24. A bottom of a front edge of the base board 21 extends forward to form an elastic portion 25 with a substantially serpentine shape. A front of the elastic portion 25 extends forward to form a substantially rectangular contact arm 26.

Referring to FIG. 3 again, the cover 30 has a rectangular base body 31 extending transversely and disposed vertically. Two ends of a top edge of the base body 31 extend upward and incline forward to form a pair of propping portions 32. Two opposite side edges of the base body 31 extend forward to form a pair of holding sections 33 facing each other, and a middle of each of the holding sections 33 defines a holding aperture 34 passing therethrough.

Referring to FIG. 3 again, the shell assembly 40 includes an upper shell 410 and a lower shell 420 mated with each other. The upper shell 410 has a rectangular top board 411 and two first side boards 412 extending downward from two opposite sides of the top board 411. Each of the first side boards 412 defines two first fixing apertures 413 spaced from each other. Two sides of the top board 411 respectively define a first receiving opening 414 extending longitudinally. A front edge of each of the receiving openings 414 extends rearward and then is arched downward to form a first resilient arm 415. A rear edge of the top board 411 extends rearward and inclines downward to form a holding board 416.

The lower shell 420 has a bottom board 421 and a pair of second side boards 422 extending upward from two opposite sides of the bottom board 421. Two sides of the bottom board 421 respectively define a second receiving opening 423 extending longitudinally. A front edge of each of the second receiving openings 423 extends rearward and then is arched upward to form a second resilient arm 424. Each of the second side boards 422 defines two second fixing apertures 425 spaced from each other and two fixing barbs 426 protruded outward, wherein the second fixing apertures 425 and the fixing barbs 426 are alternately located at the corresponding side board 422.

Referring to FIG. 2, FIG. 3 and FIG. 4, in assembly, the base board 21 and the elastic portion 25 of each of the terminals 20 are received in the corresponding receiving cavity 17 of the housing 10. The elastic portion 25 is restricted within the receiving cavity 17 by the preventing surface 19. The contact arm 26 is inserted into the corresponding inserting cavity 18 and a free end thereof stretches out of the front surface 11 of the housing 10. The fixing portion 22 is buckled in the corresponding fixing slot 101 and the holding portion 23 is held in the corresponding receiving fillister 102 so as to ensure the terminal 20 assembled in the housing 10 firmly. The soldering portion 24 is located under the bottom surface 14 for being soldered to a printed circuit board (not shown).

The base body 31 of the cover 30 covers on the rear surface 12 of the housing 10 and props against the base board 21 of the terminals 20 so as to prevent the terminals 20 from moving rearward and falling off the housing 10. The fixing lump 104 is buckled into the corresponding holding aperture 34 in order to ensure a firm engagement between the housing 10 and the cover 30. A free end of each of the propping portions 32 abuts against the rear edge of the top surface 13. The upper shell 410 is mated with the lower shell 420 to receive the housing 10 therebetween, wherein the second resilient arms 424 of the lower shell 420 abut against the bottom surface 14 of the housing 10, and the holding blocks 103 are buckled into the corresponding second fixing apertures 425. The soldering portion 24 is further located under the bottom board 421 of the lower shell 420. Then the first resilient arms 415 of the upper shell 410 are buckled in the corresponding holding grooves 105 of the housing 10 and the holding board 416 is held on the rear surface 12 and the propping portions 32. The fixing barbs 426 of the lower shell 420 are buckled into the corresponding first fixing apertures 413 of the upper shell 410.

As described above, the fixing portion 22 of each of the terminals 20 is buckled in the corresponding fixing slot 101 of the housing 10 and the holding portion 23 is held in the corresponding receiving fillister 102 so that can ensure the terminals 20 assembled in the housing 10 firmly. Moreover, the soldering portion 24 is located under the bottom surface 14 of the housing 10 so that can reduce the length of the electrical connector 1 and further reduce an occupation space of the electrical connector 1 in a matching electronic device.

What is claimed is:

1. An electrical connector, comprising:

a housing having a front surface, a rear surface and a bottom surface, the housing defining a passageway extending longitudinally to pass through the rear surface and the front surface, an upper portion of a rear of the passageway extending sideward to form a fixing slot, and a bottom thereof extending downward and then forward to form a receiving fillister penetrating through the bottom surface; and a plurality of terminals substantially disposed in the passageway of the housing and each including a base board extending vertically, a contact arm with a front end thereof projecting out of the passageway and an elastic portion elastically connecting the contact arm to the base board, a top end of the base board being bent sideward to form a fixing portion, a rear of a bottom end of the base board extending downward and then being bent forward to form a holding portion, a free end of the holding portion being bent downward and then extending forward to form a soldering portion, wherein the fixing portion is buckled in the corresponding fixing slot and the holding portion is held in the corresponding receiving fillister, the soldering portion is located under the bottom surface.

2. The electrical connector as claimed in claim 1, wherein the passageway includes a receiving cavity passing through the rear surface for receiving the base board and the elastic portion therein and an inserting cavity extending forward from a middle of a front of the corresponding receiving cavity to pass through the front surface for receiving the contact arm therein, the junction of the receiving cavity and the corresponding inserting cavity forms a preventing surface for restricting the elastic portion with the receiving cavity.

3. The electrical connector as claimed in claim 2, wherein the elastic portion is substantially serpentine shape and longitudinally extends between the base board and the contact arm.

4. The electrical connector as claimed in claim 1, further comprising a cover having a base body extending transversely and disposed vertically, two opposite ends of the base body extending forward to form a pair of holding sections facing each other, each of the holding sections defining a holding aperture passing therethrough, two opposite sides of the housing protruding outward to form a fixing lump respectively, wherein the base body is covered on the rear surface of the housing and props against the base boards of the terminals, and the fixing lump is buckled into the corresponding holding aperture.

* * * * *